US011738570B2

(12) United States Patent
Nishizawa et al.

(10) Patent No.: US 11,738,570 B2
(45) Date of Patent: Aug. 29, 2023

(54) PRINTING APPARATUS

(71) Applicant: Seiko Epson Corporation, Tokyo (JP)

(72) Inventors: Shuhei Nishizawa, Shiojiri (JP); Koji Sato, Shiojiri (JP); Yuichi Washio, Shiojiri (JP); Katsuya Asamoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/523,465

(22) Filed: Nov. 10, 2021

(65) Prior Publication Data

US 2022/0153036 A1 May 19, 2022

(30) Foreign Application Priority Data

Nov. 13, 2020 (JP) ..... 2020-189261

(51) Int. Cl.
*B41J 29/17* (2006.01)
*B41J 3/407* (2006.01)
*B41J 29/393* (2006.01)

(52) U.S. Cl.
CPC ..... *B41J 3/4078* (2013.01); *B41J 29/17* (2013.01); *B41J 29/393* (2013.01)

(58) Field of Classification Search
CPC ..... B41J 29/17; B41J 3/4078; B41J 29/38
See application file for complete search history.

(56) References Cited

U.S. PATENT DOCUMENTS

2021/0081734 A1* 3/2021 Niiyama ..... G06K 15/4065

FOREIGN PATENT DOCUMENTS

| | | | |
|---|---|---|---|
| EP | 2783876 A1 * | 10/2014 | ..... B41J 11/007 |
| JP | 2009-241285 | 10/2009 | |
| WO | 2012-073906 | 6/2012 | |

* cited by examiner

*Primary Examiner* — Scott A Richmond
(74) *Attorney, Agent, or Firm* — WORKMAN NYDEGGER

(57) ABSTRACT

The printing apparatus includes: a printing unit configured to perform printing on a fabric based on print data, a transporting belt having a support surface for supporting the fabric and configured to transport the fabric, a cleaning unit configured to clean the support surface with a cleaning liquid, a temperature change unit configured to change a temperature of the cleaning liquid, and a device control unit configured to control the temperature change unit based on at least one of attribute information of the fabric, a position of the fabric on the support surface, and the print data.

5 Claims, 3 Drawing Sheets

PRINTING APPARATUS

The present application is based on, and claims priority from JP Application Serial Number 2020-189261, filed Nov. 13, 2020, the disclosure of which is hereby incorporated by reference herein in its entirety.

BACKGROUND

1. Technical Field

The present disclosure relates to a printing apparatus including an endless belt for transporting a printing medium.

2. Related Art

JP-A-2009-241285 discloses a recording medium transport device configured to transport a recording medium in which an image is recorded by landing of ink, the recording medium transport device including: a transport member configured to transport the recording medium in a predetermined transport direction in a state where the recording medium is supported by a transport surface, a cleaning unit configured to clean the transport surface in a state where the cleaning unit is brought into contact with the transport surface from below, a jetting unit configured to directly jet a cleaning liquid to the transport surface passing through a jetted region disposed upstream of the cleaning unit in the transport direction, a storage unit disposed at least below the jetted region and the jetting unit and configured to accommodate and store a dropped cleaning liquid, and a liquid supply unit configured to supply the cleaning liquid stored in the storage unit to the jetting unit, and an inkjet recording device provided with the recording medium transport device.

However, in the recording medium transport device and the inkjet recording device disclosed in JP-A-2009-241285, the specifications for applying the cleaning liquid to the transport surface are not sufficiently considered. In recent years, from a viewpoint of enhancing environmental performance, there has been a demand for reducing a discharge amount of a waste liquid that is a used cleaning liquid, and in the case of the recording medium transport device and the inkjet recording device disclosed in JP-A-2009-241285, there has been a drawback that the amount of waste liquid is increased depending on the specification for applying the cleaning liquid.

SUMMARY

The printing apparatus according to the present disclosure includes: a printing unit configured to perform printing on a printing medium based on printing data, an endless belt having a support surface for supporting the printing medium and configured to transport the printing medium, a cleaning unit configured to clean the supporting surface with a cleaning liquid, a temperature change unit configured to change a temperature of the cleaning liquid, and a control unit configured to control the temperature change unit based on at least one of attribute information of the printing medium, a position of the printing medium on the support surface, and the printing data.

The printing apparatus according to the present disclosure includes: a printing unit configured to perform printing on a printing medium, an endless belt having a support surface for supporting the printing medium and configured to transport the printing medium, a cleaning unit configured to clean the support surface with a cleaning liquid, a temperature change unit configured to change a temperature of the cleaning liquid, wherein the cleaning unit includes a rotary brush configured to rotate in contact with the support surface, a first jet portion configured to jet the cleaning liquid to the support surface downstream of the printing unit and upstream of the rotary brush in a moving direction of the endless belt, and a second jet portion configured to jet the cleaning liquid to the rotary brush, the temperature change unit includes a heating unit configured to heat the cleaning liquid, and a cooling unit configured to cool the cleaning liquid, the cleaning liquid cooled by the cooling unit is jetted from the first jet portion, and the cleaning liquid heated by the heating unit is jetted from the second jet portion.

DESCRIPTION OF EXEMPLARY EMBODIMENTS

Figure 1:
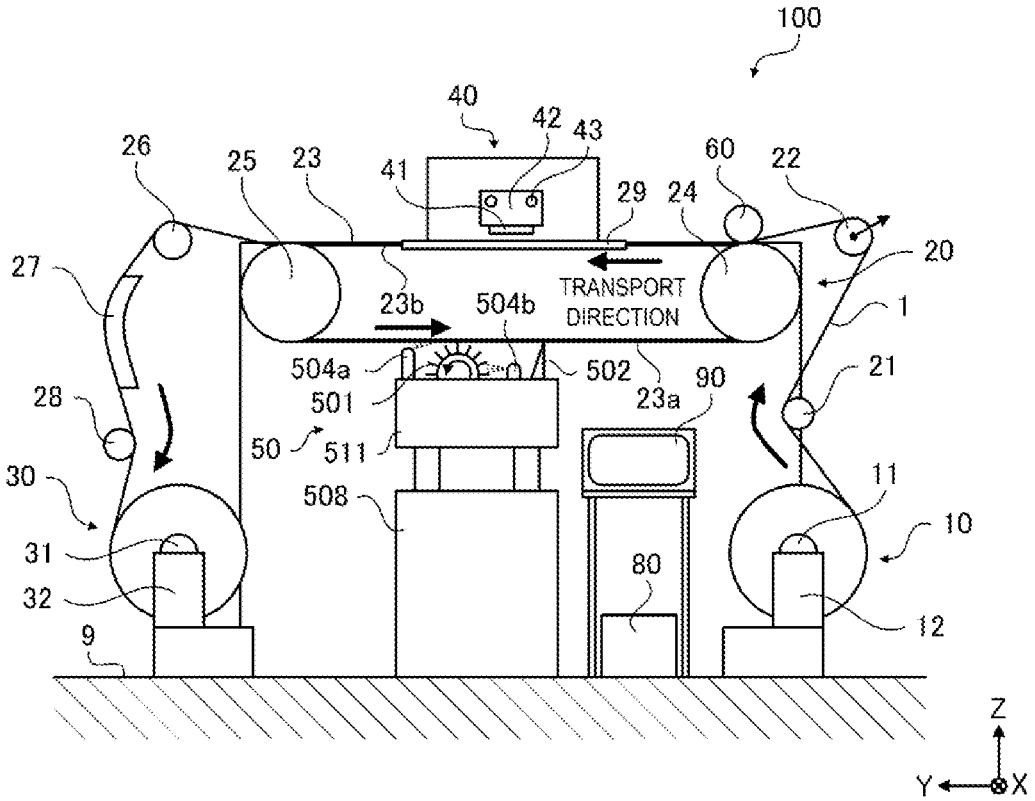
FIG. 1 is a front view illustrating a configuration of a printing apparatus according to an embodiment.

A configuration of a printing apparatus according to an embodiment is described with reference to FIG. 1.

In coordinates given in the drawings, a Z axis direction is defined as a vertical direction, a +Z direction is defined as an upward direction, an X axis direction is defined as a fore-and-aft direction, a −X direction is defined as a frontward direction, a Y axis direction is defined as a lateral direction, a +Y direction is defined as a leftward direction, and an X-Y plane is defined as a horizontal plane.

The printing apparatus 100 is an ink-jet-type fabric printing apparatus configured to perform fabric printing on a fabric 1 by forming an image by ejecting ink droplets as droplets onto the fabric 1 as a printing medium. As the fabric 1, a fabric such as cotton, silk, wool, chemical fiber, a mixture of these fabrics, or the like is used, for example.

The printing apparatus 100 is constituted of a supply unit 10, a transport unit 20, a collection unit 30, a printing unit 40, a cleaning unit 50, a pressing unit 60, a device control unit 80 as a control unit, an image processing device 90, and the like.

The supply unit 10 is configured to accommodate the fabric 1 before printing. The supply unit 10 includes a shaft portion 11 and a bearing portion 12.

The shaft portion 11 is configured to rotatably support the strip-shaped fabric 1 wound in a roll shape in a circumferential direction of the shaft portion 11. The shaft portion 11 is detachably mounted on the bearing portion 12.

The bearing portion 12 has a rotary drive portion configured to rotate and drive the shaft portion 11 thus rotatably supporting the shaft portion 11. The rotary drive portion is controlled by the device control unit 80, and is configured to rotate the shaft portion 11 in a direction that the fabric 1 is fed when a fabric that is easy to stretch is used as the fabric 1. Further, in a case where a fabric to which tension is needed to be applied is used as the fabric 1, the rotary control unit performs a control of applying a load to the shaft portion 11 such that the shaft portion 11 is not rotated. An illustration of the rotary drive portion is omitted.

The transport unit 20 constitutes a transport path that extends from the supply unit 10 to the collection unit 30 through the printing unit 40 and along which the fabric 1 is transported. The transport unit 20 includes transport rollers 21, 26, and 28, a tension roller 22, a transporting belt 23, a belt rotating roller 24, a belt driving roller 25, a drying unit 27, a belt guide 29, and the like.

The transporting belt 23 is an endless belt formed in an endless state, and is wound and suspended around the belt rotating roller 24 and the belt driving roller 25. The transporting belt 23 is held in a state where predetermined tension acts on the transporting belt 23 such that a portion of the transporting belt 23 wound around and extended between the belt rotating roller 24 and the belt driving roller 25 is disposed parallel to a floor surface 9. An outer peripheral surface of the transporting belt 23 forms a support surface 23*a* for supporting the fabric 1, and an adhesive layer that causes the fabric 1 to adhere to the support surface 23*a* is formed on a surface of the support surface 23*a*.

The belt rotating roller 24 and the belt driving roller 25 are configured to support an inner peripheral surface 23*b* of the transporting belt 23. Here, a configuration may be adopted where a support portion configured to support the transporting belt 23 from the inner peripheral surface 23*b* is provided between the belt rotating roller 24 and the belt driving roller 25.

In the transport path, the belt driving roller 25 is disposed downstream of the belt rotating roller 24. The rotation of the belt driving roller 25 is controlled by the device control unit 80. Due to the rotation of the belt driving roller 25, the transporting belt 23 is rotated, and the belt rotating roller 24 is rotated along with the rotation of the transporting belt 23. Due to the rotation of the transporting belt 23, the fabric 1 supported by the support surface 23*a* of the transporting belt 23 is transported in a transport direction. That is, a direction from the belt rotating roller 24 toward the belt driving roller 25 is defined as the transport direction.

The tension roller 22 is provided between the supply unit 10 and the transporting belt 23 in the transport path, and applies a predetermined tension to the fabric 1 between the tension roller 22 and the transporting belt 23.

The transport roller 21 relays the fabric 1 between the supply unit 10 and the tension roller 22.

The transport roller 26 and the transport roller 28 relay the fabric 1 transported by the transporting belt 23 between the transporting belt 23 and the collection unit 30.

The drying unit 27 is provided between the transport roller 26 and the transport roller 28, and is configured to dry the fabric 1 to which ink has been applied.

The belt guide 29 is a guide having a flat plate shape disposed in a printing region of the transporting belt 23 facing the printing unit 40, and is configured to suppress displacement of the transporting belt 23 in a direction intersecting with the transport direction in the printing region.

The collection unit 30 is configured to accommodate the fabric 1 where drying of applied ink has been completed. The collection unit 30 includes a shaft portion 31 and a bearing portion 32.

The shaft portion 31 is disposed in a rotatable manner in a circumferential direction thereof so as to wind and accommodate the fabric 1 in a roll shape. The shaft portion 31 is detachably mounted on the bearing portion 32.

The bearing portion 32 has a rotary drive portion configured to rotate and drive the shaft portion 31 thus rotatably supporting the shaft portion 31. The rotary drive portion is controlled by the device control unit 80, and is configured to rotate the shaft portion 31 in a direction that the fabric 1 is wound. An illustration of the rotary drive portion is omitted.

The printing unit 40 is controlled by the device control unit 80, and is configured to eject ink droplets onto the fabric 1. The printing unit 40 includes a head 41 as a droplet ejecting unit, a carriage 42, and an ink supply unit. An illustration of the ink supply unit is omitted.

The head 41 is disposed so as to face the fabric 1 transported by the transporting belt 23, and includes a plurality of nozzles for ejecting ink supplied from the ink supply unit as ink droplets on a lower surface thereof.

The carriage 42 mounts the head 41 thereon, and is configured to move along a guide shaft 43 provided so as to extend in the X axis direction intersecting with the transport direction of the fabric 1. The movement of the carriage 42 is controlled by a carriage motor controlled by the device control unit 80. An illustration of the carriage motor is omitted.

The cleaning unit 50 is controlled by the device control unit 80, and is configured to perform cleaning of the transporting belt 23. The cleaning unit 50 is described later.

The pressing unit 60 is disposed on an upper portion of the transporting belt 23 upstream of the printing unit 40 in the transport path. The pressing unit 60 is configured to press the fabric 1 to the support surface 23*a* having the adhesive layer thus preventing the fabric 1 from being separated from the transporting belt 23.

Figure 2:
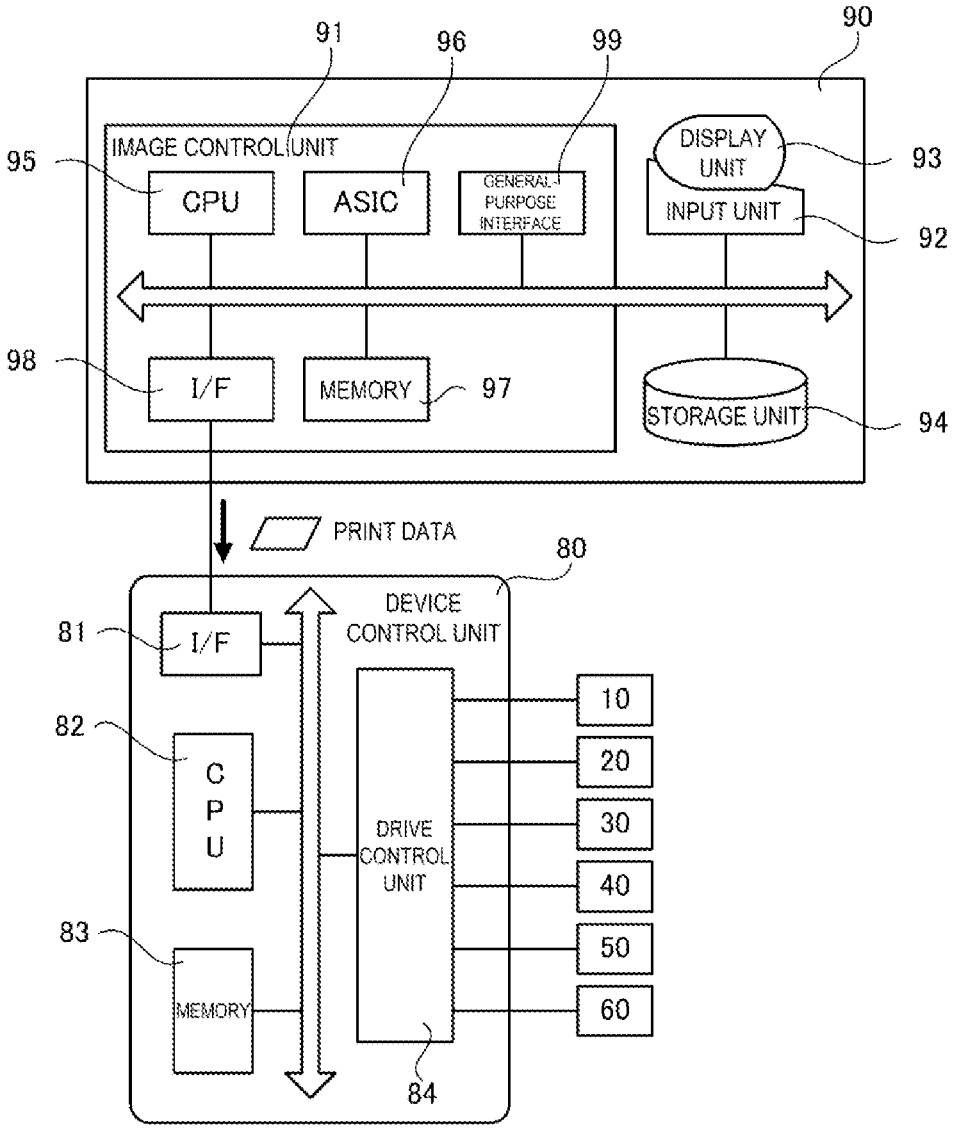
FIG. 2 is a block diagram explaining functions of a control unit and an image processing device that the printing apparatus includes.

Functions of the device control unit 80 and the image processing device 90 are described with reference to FIG. 2.

The image processing device 90 includes an image control unit 91, an input unit 92, a display unit 93, a storage unit 94, and the like, and is configured to perform transmission and reception of data with an external electronic apparatus that is connected to the image processing device 90 via a network or the like, control of a print job performed by the printing apparatus 100, processing of images related to printing, and the like. The image processing device 90 is constituted using a personal computer as a preferred example.

Software run by the image processing device 90 includes a general image processing application for handling image data to be printed, and a printer driver for generating print data necessary for the printing apparatus 100 to perform printing based on the image data.

The image control unit 91 includes a CPU 95, an ASIC 96, a memory 97, a built-in interface 98, a general-purpose interface 99, and the like. The CPU means the Central Processing Unit, and the ASIC means the Application Specific Integrated Circuit. The input unit 92 is an information input unit serving as a human interface. To be more specific, the input unit 92 is a keyboard, a mouse pointer, or the like, for example.

The display unit 93 is an information display unit serving as a human interface, and is configured to display information input from the input unit 92, images to be printed, information related to print jobs, and the like, under the control of the image control unit 91.

The storage unit 94 is a rewritable storage medium such as a hard disk drive or a memory card, and is configured to store software run by the image processing device 90, images to be printed, information related to the print jobs, and the like.

The ASIC 96 contributes to generation of print data under the control of the CPU 95 based on the printer driver.

The memory 97 is a storage medium configured to secure a region for storing programs run by the CPU 95, a work region for running the programs, and the like.

The general-purpose interface 99 is an interface for connecting the image processing device 90 to the external electronic apparatus by connecting the image processing device 90 to a network or the like.

The device control unit 80 includes a built-in interface 81, a CPU 82, a memory 83, a drive control unit 84, and the like, and is configured to control respective drive units of the printing apparatus 100 comprehensively. To be more specific, the device control unit 80 is configured to perform ink ejection control with respect to the head 41 of the printing unit 40, head movement control with respect to the carriage 42, transport drive control with respect to the transport unit 20, and the like.

At the time of performing printing, the device control unit 80 is configured to repeat an operation of ejecting ink droplets from the head 41 to the fabric 1 supplied to the printing region by the transport unit 20 while moving the carriage 42 supporting the head 41 along the guide shaft 43 in the X axis direction, and an operation of moving the fabric 1 in the +Y direction in the printing region by the transporting belt 23 of the transport unit 20 in accordance with print data transmitted from the image processing device 90. Due to repetition of such operations, a desired image is printed on the fabric 1.

The built-in interface 81 is connected to the built-in interface 98 of the image processing device 90 thus performing transmission and reception of data with the image processing device 90.

The CPU 82 is an arithmetic processing device for driving and controlling the whole printing apparatus 100.

The memory 83 is a storage medium configured to secure a region for storing programs run by the CPU 82, a work region for running the programs, and the like.

The CPU 82 is configured to control the supply unit 10, the transport unit 20, the collection unit 30, the printing unit 40, the cleaning unit 50, and the pressing unit 60 via the drive control unit 84 in accordance with the programs stored in the memory 83 and print data received from the image processing device 90.

Figure 3:
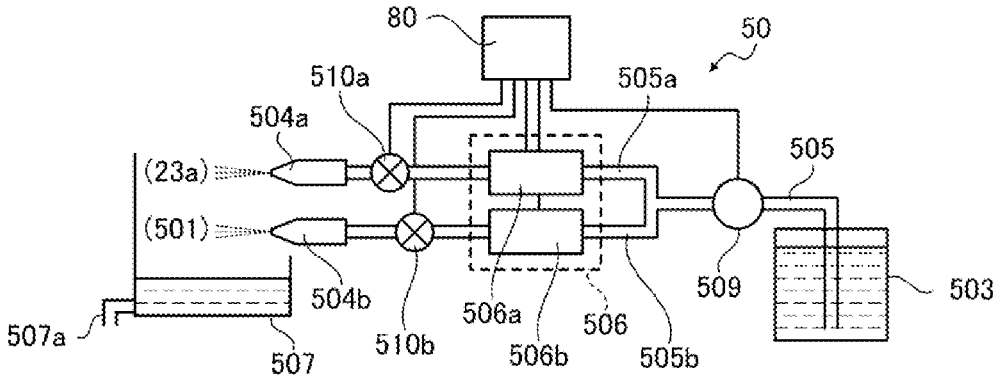
FIG. 3 is a conceptual view illustrating a configuration of a cleaning unit.

Next, the cleaning unit 50 is described with reference to FIG. 1 and FIG. 3.

The cleaning unit 50 is disposed below an area between the belt driving roller 25 and the belt rotating roller 24, and is configured to clean the support surface 23*a* of the transporting belt 23 after the fabric 1 is peeled off using a cleaning liquid from below thus removing foreign materials such as ink, dust, lint, and the like sticking to the support surface 23*a*.

The cleaning unit 50 includes a rotary brush 501, a wiper 502, a cleaning liquid tank 503, a jet nozzle 504, a cleaning liquid supply path 505, a temperature change unit 506, a waste liquid storage tank 507, a lifting mechanism 508, and the like.

The rotary brush 501 is a brush having a circular cylindrical shape that rotates in a state where the rotary brush 501 is supported on a rotary shaft extending in the X axis direction, and is configured such that a length of the rotary brush 501 in the X axis direction is larger than a width of the transporting belt 23, and the rotary brush 501 rotates while coming into contact with the transporting belt 23 over the whole width of the transporting belt 23. The rotary brush 501 is rotated by a brush motor driven and controlled by the device control unit 80. As indicated by an arrow in FIG. 1, a rotational direction of the rotary brush 501 is a direction that a distal end of the rotary brush 501 that is brought into contact with the support surface 23*a* is moved in a direction opposite to a moving direction of the transporting belt 23. An illustration of the brush motor is omitted.

The wiper 502 is a rubber blade capable of wiping the cleaning liquid or the like sticking to the support surface 23*a* by bringing a distal end thereof into contact with the support surface 23*a* of the rotating transporting belt 23.

The cleaning liquid tank 503 is a tank for storing the cleaning liquid. As the cleaning liquid, for example, water or a water-soluble solvent such as alcoholic aqueous solution or the like is used, and a surfactant and an anti-foaming agent is added to the cleaning liquid when necessary.

The jet nozzle 504 includes a jet nozzle 504*a* as a first jet portion for jetting the cleaning liquid to the support surface 23*a*, and a jet nozzle 504*b* as a second jet portion for jetting the cleaning liquid to the rotary brush 501.

The jet nozzle 504*a* is disposed downstream of the printing unit 40 and upstream of the rotary brush 501 in the moving direction of the transporting belt 23, and is configured to jet the cleaning liquid to the support surface 23*a* from below.

The jet nozzle 504*b* is disposed downstream of the rotary brush 501, and is configured to jet the cleaning liquid to the rotary brush 501 from the side of the rotary brush 501.

The cleaning liquid supply path 505 is a flow path through which the cleaning liquid stored in the cleaning liquid tank 503 is supplied to the jet nozzle 504, and is branched into a cleaning liquid supply path 505*a* through which the cleaning liquid is supplied to the jet nozzle 504*a*, and a cleaning liquid supply path 505*b* through which the cleaning liquid is supplied to the jet nozzle 504*b*.

A pump 509 whose driving is controlled by the device control unit 80 is disposed upstream of a branched portion of the cleaning liquid supply path 505.

An opening/closing valve 510*a* is disposed in the cleaning liquid supply path 505*a*, and an opening/closing valve 510*b* is disposed in the cleaning liquid supply path 505*b*. The device control unit 80 is configured to control jetting of the cleaning liquid from the jet nozzle 504*a* and the jet nozzle 504*b* by controlling opening and closing of the opening/closing valve 510*a* and the opening/closing valve 510*b* respectively.

The temperature change unit 506 can change a temperature of the cleaning liquid jetted by the jet nozzle 504. The temperature change unit 506 includes a first temperature change unit 506*a* configured to change a temperature of the cleaning liquid in the cleaning liquid supply path 505*a*, and a second temperature change unit 506*b* configured to change a temperature of the cleaning liquid in the cleaning liquid supply path 505*b*.

The first temperature change unit 506*a* and the second temperature change unit 506*b* are respectively controlled by the device control unit 80. That is, the device control unit 80 is configured to control the temperature of the cleaning liquid jetted from the jet nozzle 504*a* and the jet nozzle 504*b* by controlling the temperature change unit 506.

The waste liquid storage tank 507 is a bucket configured to receive the cleaning liquid that the jet nozzle 504*a* jets to the support surface 23*a* and the cleaning liquid that the jet nozzle 504*b* jets to the rotary brush 501 from below and store the cleaning liquid as a waste liquid, and is configured to discharge the cleaning liquid as the waste liquid from a discharge port 507*a* formed in the waste liquid storage tank 507 at a position close to a bottom portion.

The lifting mechanism 508 is configured to lift and lower a base portion 511 supporting the rotary brush 501, the wiper 502, the cleaning liquid tank 503, the jet nozzle 504, the cleaning liquid supply path 505, the temperature change unit 506, the waste liquid storage tank 507, and the like in the Z direction. The rotary brush 501 and the wiper 502 are movable to a cleaning position where the rotary brush 501 and the wiper 502 are brought into contact with the support surface 23*a* of the transporting belt 23 and a separation position where the rotary brush 501 and the wiper 502 are separated from the support surface 23*a* of the transporting belt 23 due to lifting and lowering operation of the lifting mechanism 508.

In the configuration described above, the device control unit 80 is configured to control the temperature change unit 506 based on at least one of attribute information of the fabric 1, a position of the fabric 1 on the support surface 23*a*, and the print data so as to efficiently and effectively perform the cleaning of the transporting belt 23 by the cleaning unit 50.

To be more specific, the device control unit 80 is configured to control a temperature of the cleaning liquid jetted from the jet nozzle 504*a* and a temperature of the cleaning liquid jetted from the jet nozzle 504*b* based on at least one of the attribute information of the fabric 1, the position of the fabric 1 on the support surface 23*a*, and the print data.

The attribute information of the fabric 1 is information capable of identifying a type of the fabric 1 and, as such information, a product name or a product number of the fabric 1 can be named, for example. The attribute information of the fabric 1 may be information such as a material name, a constitutional specification of the fabric 1, for example.

A generation state of foreign materials such as dust, lint, and the like sticking to the support surface 23*a* differs depending on a type of the fabric 1. Further, the degree of sticking of ink to the support surface 23*a* through the fabric 1 at the time of performing printing differs depending on the type of the fabric 1. Accordingly, for example, when the higher cleaning power is expected as the temperature of the cleaning liquid is increased in peeling-off the foreign materials such as ink, dust, lint, and the like sticking to the support surface 23*a* from the support surface 23*a*, in a case where the fabric 1 is a fabric that a generation amount of dust, lint, and the like is large or a fabric that a sticking amount of ink is large, for example, the device control unit 80 performs control of increasing the temperature of the cleaning liquid. Further, to the contrary, in a case where the fabric 1 is a fabric that a generation amount of dust, lint, and the like is small and does not allow penetration of ink, the cleaning power for cleaning the support surface 23*a* can be decreased and hence, it becomes unnecessary for the device control unit 80 to perform the control of increasing the temperature of the cleaning liquid.

Accordingly, by performing a pre-evaluation with respect to the fabric 1 and by setting a temperature of the cleaning liquid as a cleaning specification corresponding to a type or the like of the fabric 1, the device control unit 80 controls the temperature change unit 506 based on the attribute information of the fabric 1 such that a temperature of the cleaning liquid becomes a temperature corresponding to the fabric 1 and hence, further efficient and effective cleaning can be performed.

A position of the fabric 1 on the support surface 23*a* corresponds to a region where foreign materials such as dust, lint, and the like stick to the support surface 23*a*. The larger the region where the foreign materials such as dust, lint, and the like stick to the support surface 23*a*, the larger a total amount of foreign materials sticking to the support surface 23*a* becomes. Therefore, for example, when the higher cleaning power is expected as the temperature of the cleaning liquid is increased in peeling-off the foreign materials such as dust, lint, and the like sticking to the support surface 23*a* from the support surface 23*a*, in a case where the fabric 1 is a fabric that a total amount of dust, lint, and the like sticking to the support surface 23*a* is large, for example, the device control unit 80 performs control of increasing the temperature of the cleaning liquid. To the contrary, in a case where the fabric 1 is a fabric that a total amount of dust, lint, and the like sticking to the support surface 23*a* is small, the cleaning power for cleaning the support surface 23*a* can be decreased and hence, it becomes unnecessary for the device control unit 80 to perform control of increasing the temperature of the cleaning liquid.

Accordingly, by performing a pre-evaluation with respect to the fabric 1 and by setting a temperature of the cleaning liquid as a cleaning specification corresponding to a type and a width of the fabric 1, the device control unit 80 controls the temperature change unit 506 based on a position of the fabric 1, that is, a width size of the fabric 1 such that a temperature of the cleaning liquid becomes a temperature corresponding to the fabric 1 and hence, further efficient and effective cleaning can be performed.

Although the information of the width of the fabric 1 can also be obtained as the attribute information of the fabric 1, by detecting a position where the fabric 1 is actually stuck to the support surface 23*a*, the information of the width of the fabric 1 can be obtained.

The printing apparatus 100 according to the present embodiment includes detection units 70 configured to detect a position of the fabric 1 supported by the support surface 23*a*.

Figure 4:
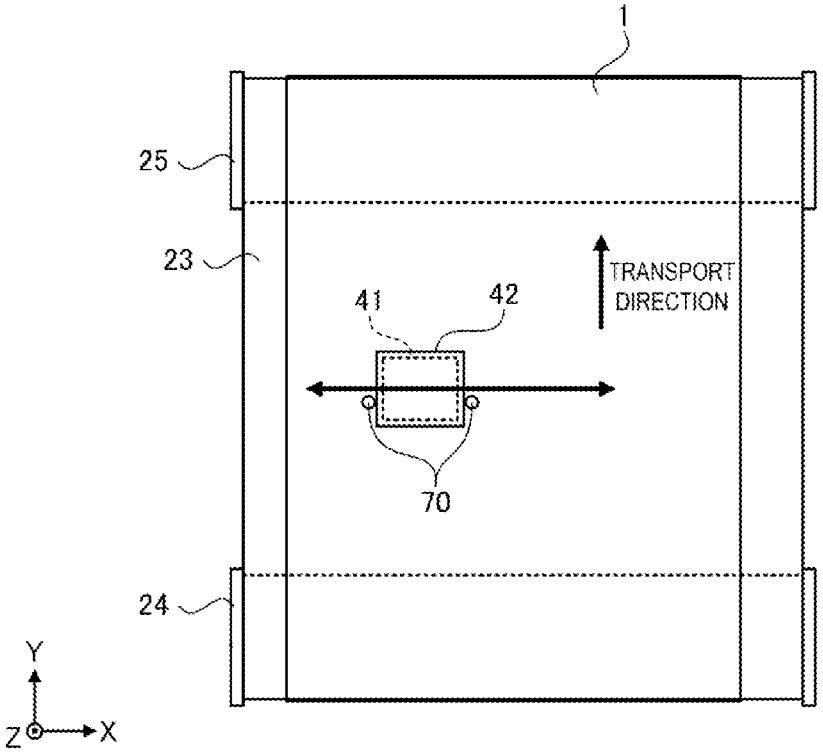
FIG. 4 is a plan view illustrating an arrangement of a detection unit.

The detection units 70 are each constituted by a photo sensor configured to irradiate the fabric 1 with light and detect reflected light. As illustrated in FIG. 4, the detection units 70 are disposed at both end portions of the carriage 42 in the X axis direction respectively. Since the carriage 42 detects reflected light from the fabric 1 supported by the support surface 23*a* while moving in the width direction of the transporting belt 23, the position and the width of the fabric 1 can be detected. The device control unit 80 receives a detection result of the detection unit 70, and recognizes the position of the fabric 1.

That is, the carriage 42 includes the detection units 70 each configured to detect a position of the fabric 1 supported by the support surface 23*a* while moving in the width direction of the transporting belt 23, and the device control unit 80 recognizes the position of the fabric 1 based on the detection result of the detection unit 70.

The print data is control information for applying ink to the fabric 1, and the device control unit 80 can obtain information of a position at which ink is to be applied and an amount of ink to be applied from the print data.

For example, in a case where the fabric 1 is a fabric having an ink permeability, when the degree of ink permeability is known in advance, a position and an amount of ink sticking to the support surface 23*a* through the fabric 1 can be estimated by referring to the print data. For example, when the higher cleaning power is expected as the temperature of the cleaning liquid is increased in peeling-off ink sticking to the support surface 23*a* from the support surface 23*a*, for example, when it is estimated that an amount of ink sticking to the support surface 23*a* is large, the device control unit 80 performs control of increasing the temperature of the cleaning liquid. To the contrary, when it is estimated that an amount of ink sticking to the support surface 23*a* is small, the cleaning power for cleaning the support surface 23*a* can be decreased and hence, it becomes unnecessary for the device control unit 80 to perform control of increasing the temperature of the cleaning liquid.

Here, when the cleaning is continued in a state where the temperature of the cleaning liquid is increased, depending on an environment, the temperature of the transporting belt 23, that is, a temperature of the adhesive layer of the support surface 23*a* is excessively increased and hence, there arises a case where a predetermined adhesive force cannot be obtained, an adhesive force is excessively increased, or the adhesive layer is easily peeled off from the support surface 23*a*.

To the contrary, it is preferable that one of the temperature change units 506 be constituted as a cooling unit. To be more specific, for example, the first temperature change unit 506*a* is constituted as a cooling unit, and the second temperature change unit 506*b* is constituted as a heating unit.

When the first temperature change unit 506*a* is constituted as a cooling unit, the first temperature change unit 506*a* can be constituted by a cooling element such as a Peltier element disposed at at least a portion of the cleaning liquid supply path 505*a*. Further, when the second temperature change unit 506*b* is constituted as a heating unit, the second temperature change unit 506*b* can be constituted by an electric heating wire or the like disposed at at least a portion of the cleaning liquid supply path 505*b*. Here, it is preferable that temperature of the cleaning liquid is cooled by the first temperature change unit 506*a* is greater than or equal to −10° C. and smaller than or equal to 20° C. In addition, it is preferable that temperature of the cleaning liquid heated by the second temperature change unit 506*b* is greater than 20° C. and smaller than or equal to 90° C.

With such a configuration, it is possible to suppress that a temperature of the adhesive layer becomes a predetermined temperature or above.

According to the present embodiment, the following advantageous effects can be obtained.

The printing apparatus 100 according to the present embodiment includes: the cleaning unit 50 configured to clean the support surface 23*a* of the transporting belt 23 supporting the fabric 1 with the cleaning liquid, the temperature change unit 506 configured to change the temperature of the cleaning liquid, the device control unit 80 configured to control the temperature change unit 506 based on at least one of the attribute information of the fabric 1, the position of the fabric 1 on the support surface 23*a*, and the print data. Accordingly, the temperature of the cleaning liquid for cleaning the support surface 23*a* can be changed based on at least one of the attribute information of the fabric 1, the position of the fabric 1 on the support surface 23*a*, and the print data. As a result, cleaning of the support surface 23*a* can be performed with the cleaning liquid of a temperature that cleaning can be performed efficiently and effectively and hence, the discharge amount of a waste liquid that is the used cleaning liquid can be decreased.

Further, the cleaning unit 50 includes the rotary brush 501 configured to rotate in a state where the rotary brush 501 is brought into contact with the support surface 23*a* of the transporting belt 23 that supports the fabric 1, and the jet nozzle 504*a* configured to jet the cleaning liquid to the support surface 23*a* downstream of the printing unit 40 and upstream of the rotary brush 501 in the moving direction of the transporting belt 23. The device control unit 80 is configured to control the temperature of the cleaning liquid jetted from the jet nozzle 504*a* based on at least one of the attribute information of the fabric 1, the position of the fabric 1 on the support surface 23*a*, and the print data. Since the cleaning liquid is jetted to the support surface 23*a* upstream of the rotary brush 501 that rotates in a state where the rotary brush 501 is brought into contact with the support surface 23*a*, the cleaning of the support surface 23*a* can be efficiently and effectively performed by the rotary brush 501. Further, the cleaning of the support surface 23*a* can be performed with the cleaning liquid of a temperature that the cleaning can be performed efficiently and effectively. As a result, the discharge amount of the waste liquid that is the used cleaning liquid can be decreased.

Further, the cleaning unit 50 includes the jet nozzle 504*b* configured to jet the cleaning liquid to the rotary brush 501 that rotates in a state where the rotary brush 501 is brought into contact with the support surface 23*a* of the transporting belt 23 that supports the fabric 1. Since the cleaning liquid is jetted to the rotary brush 501 that rotates in a state where the rotary brush 501 is brought into contact with the support surface 23*a*, the cleaning of the support surface 23*a* can be efficiently and effectively performed by the rotary brush 501. Further, dirt, foreign materials, and the like sticking to the rotary brush 501 can be removed.

Further, the device control unit 80 is configured to control the temperature of the cleaning liquid jetted from the jet nozzle 504*b* based on at least one of the attribute information of the fabric 1, the position of the fabric 1 on the support surface 23*a*, and the print data. Accordingly, the cleaning of the support surface 23*a* can be performed with the cleaning liquid of a temperature that the cleaning can be performed efficiently and effectively.

As a result, the discharge amount of the waste liquid that is the used cleaning liquid can be decreased.

Further, the transporting belt 23 includes the adhesive layer that causes the fabric 1 to adhere to the support surface 23*a*. The temperature change unit 506 includes the first temperature change unit 506*a* configured to change the temperature of the cleaning liquid in the cleaning liquid supply path 505*a*, and the second temperature change unit 506*b* configured to change the temperature of the cleaning liquid in the cleaning liquid supply path 505*b*. When the first temperature change unit 506*a* is constituted as the cooling unit and the second temperature change unit 506*b* is constituted as the heating unit, the cleaning liquid cooled by the cooling unit is jetted from the jet nozzle 504*a*, and the cleaning liquid heated by the heating unit is jetted from the jet nozzle 504*b*. That is, the cooled cleaning liquid is jetted to the support surface 23*a* having the adhesive layer upstream of the rotary brush 501 in the moving direction of the transporting belt 23, and the heated cleaning liquid is jetted to the rotary brush 501. The cleaning liquid jetted to the rotary brush 501 is heated and hence, dirt, foreign materials, and the like sticking to the rotary brush 501 can be easily removed. Further, the cleaning liquid jetted to the support surface 23*a* having the adhesive layer is cooled and hence, it is possible to suppress that a temperature of the adhesive layer becomes a predetermined temperature or above. For example, it is possible to suppress that a temperature of the adhesive layer becomes a predetermined temperature or above due to an influence of the heated cleaning liquid and an influence of an environment where the printing apparatus 100 is installed and hence, the deterioration of durability of the support surface 23*a*, such as peeling-off of the adhesive layer and the like, can be suppressed.

Further, the printing unit 40 includes the head 41 configured to eject droplets to the fabric 1, and the carriage 42 that is mounted with the head 41 thereon and is configured to move in the width direction of the transporting belt 23. The carriage 42 includes the detection units 70 each configured to detect the position of the fabric 1 supported by the support surface 23*a* while moving in the width direction of the transporting belt 23, and the device control unit 80 recognizes the position of the fabric 1 based on the detection result of the detection units 70.

The position at which foreign materials or a liquid such as ink stick to the support surface 23*a* of the transporting belt 23, that is, the region of the support surface 23*a* to be cleaned is changed depending on the position at which the fabric 1 is supported by the transporting belt 23. According to the present embodiment, the device control unit 80 is configured to recognize the position of the fabric 1 based on the detection result of the detection units 70 capable of detecting the position of the fabric 1 supported by the support surface 23*a* and hence, the device control unit 80 can appropriately perform control of the temperature of the cleaning liquid corresponding to an actual width size of the fabric 1 and an actual position at which the fabric 1 having such a width size is supported. As a result, cleaning can be performed more efficiently and effectively and hence, it is possible to decrease the discharge amount of a waste liquid that is the used cleaning liquid.

What is claimed is:

1. A printing apparatus comprising:

a printing unit configured to perform printing on a printing medium based on print data;

an endless belt having a support surface for supporting the printing medium and configured to transport the printing medium;

a cleaning unit configured to clean the support surface with a cleaning liquid;

a temperature change unit configured to change a temperature of the cleaning liquid; and a control unit configured to control the temperature change unit based on at least one of attribute information of the printing medium, a position of the printing medium on the support surface, and the print data, wherein the cleaning unit includes:

a rotary brush configured to rotate in contact with the support surface;

a first jet portion configured to jet the cleaning liquid to the support surface downstream of the printing unit and upstream of the rotary brush in a moving direction of the endless belt;

a second jet portion configured to jet the cleaning liquid to the rotary brush, wherein the control unit is configured to control a temperature of the cleaning liquid jetted from the first jet portion based on at least one of the attribute information of the printing medium, the position of the printing medium on the support surface, and the print data, and the control unit is configured to control a temperature of the cleaning liquid jetted from the second jet portion based on at least one of the attribute information of the printing medium, the position of the printing medium on the support surface, and the print data.

2. The printing apparatus according to claim 1, wherein the endless belt includes an adhesive layer that causes the printing medium to adhere to the support surface, the temperature change unit includes a heating unit configured to heat the cleaning liquid, and a cooling unit configured to cool the cleaning liquid, the cleaning liquid cooled by the cooling unit is jetted from the first jet portion, and the cleaning liquid heated by the heating unit is jetted from the second jet portion.

3. The printing apparatus according to claim 1, wherein the printing unit includes:

a droplet ejection unit configured to eject droplets to the printing medium; and a carriage that is mounted with the droplet ejection unit and is configured to move in a width direction of the endless belt, and the carriage includes a detection unit configured to detect a position of the printing medium supported by the support surface while moving in the width direction of the endless belt, and the control unit is configured to recognize the position of the printing medium based on a detection result of the detection unit.

4. A printing apparatus comprising:

a printing unit configured to perform printing on a printing medium based on print data;

an endless belt having a support surface for supporting the printing medium and configured to transport the printing medium;

a cleaning unit configured to clean the support surface with a cleaning liquid;

a temperature change unit configured to change a temperature of the cleaning liquid; and a control unit configured to control the temperature change unit based on at least one of attribute information of the printing medium, a position of the printing medium on the support surface, and the print data, wherein the cleaning unit includes:

a rotary brush configured to rotate in contact with the support surface;

a first jet portion configured to jet the cleaning liquid to the support surface downstream of the printing unit and upstream of the rotary brush in a moving direction of the endless belt; and a second jet portion configured to jet the cleaning liquid to the rotary brush, the endless belt includes an adhesive layer that causes the printing medium to adhere to the support surface, the temperature change unit includes a heating unit configured to heat the cleaning liquid, and a cooling unit configured to cool the cleaning liquid, the cleaning liquid cooled by the cooling unit is jetted from the first jet portion, and the cleaning liquid heated by the heating unit is jetted from the second jet portion.

5. A printing apparatus comprising:

a printing unit configured to perform printing on a printing medium;

an endless belt having a support surface for supporting the printing medium and configured to transport the printing medium;

a cleaning unit configured to clean the support surface with a cleaning liquid;

a temperature change unit configured to change a temperature of the cleaning liquid, wherein the cleaning unit includes:

a rotary brush configured to rotate in contact with the support surface;

a first jet portion configured to jet the cleaning liquid to the support surface downstream of the printing unit and upstream of the rotary brush in a moving direction of the endless belt; and a second jet portion configured to jet the cleaning liquid to the rotary brush, the temperature change unit includes a heating unit configured to heat the cleaning liquid, and a cooling unit configured to cool the cleaning liquid, the cleaning liquid cooled by the cooling unit is jetted from the first jet portion, and the cleaning liquid heated by the heating unit is jetted from the second jet portion.

* * * * *